US006010366A

United States Patent [19]

Tanigawa et al.

[11] Patent Number: 6,010,366

[45] Date of Patent: Jan. 4, 2000

[54] MOLD-TYPE ELECTRONIC PART-CONTAINING CONNECTOR

[75] Inventors: Fumiyoshi Tanigawa, Yokkaichi; Tessho Yamada; Yoshihide Kami, both of Nagoya, all of Japan

[73] Assignees: Sumitomo Wiring Systems, Ltd., Yokkaichi; NGK Spark Plug Co., Ltd., Nagoya, both of Japan

[21] Appl. No.: 09/014,619

[22] Filed: Jan. 28, 1998

[30] Foreign Application Priority Data

Jan. 31, 1997 [JP] Japan ..... 9-019293

[51] Int. Cl.[7] ..... H01R 13/66

[52] U.S. Cl. ..... 439/620; 439/907

[58] Field of Search ..... 439/907, 620–622

[56] References Cited

FOREIGN PATENT DOCUMENTS 60-89083 5/1985 Japan .
60-178656 9/1985 Japan .

*Primary Examiner*—Michael L. Gellner
*Assistant Examiner*—Briggitte R. Hammond
*Attorney, Agent, or Firm*—Oliff & Berridge, PLC

[57] ABSTRACT

A branch metal terminal has a branch lead terminal portion with a branch wire connected to this terminal portion through a branch female metal terminal. The branch wire is connected to a female-side wire connected to a mold-type electronic part.

11 Claims, 7 Drawing Sheets

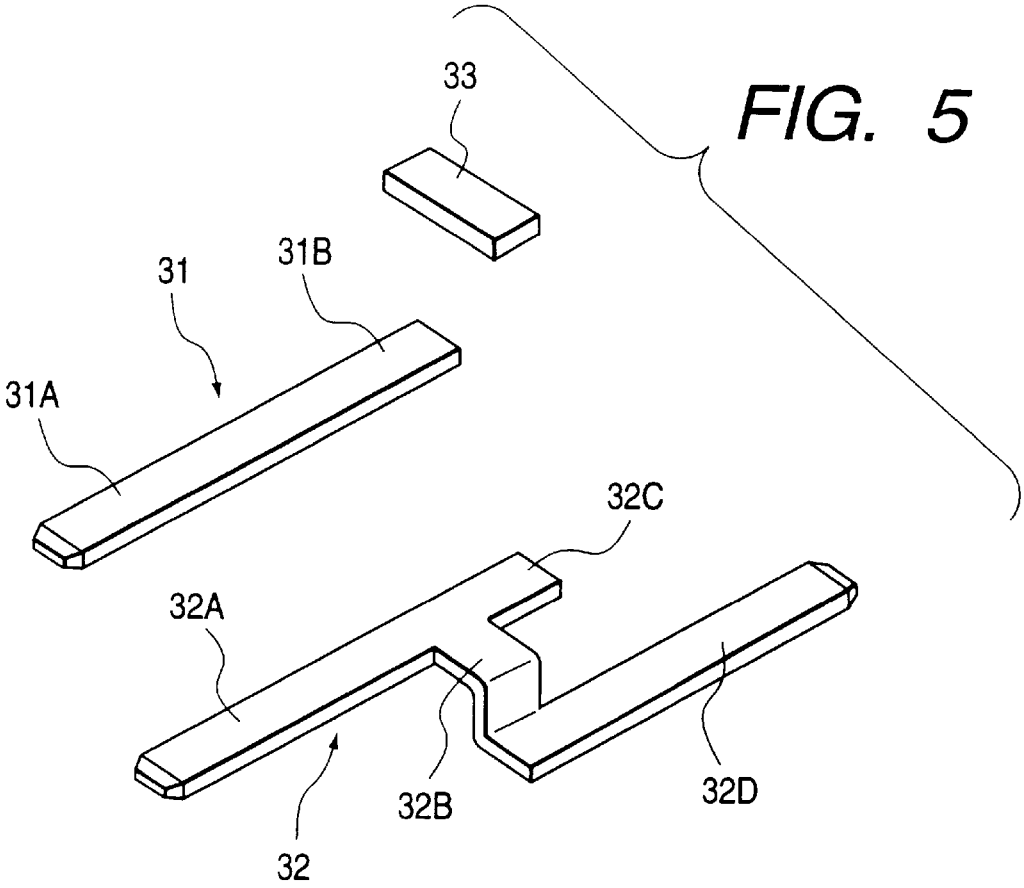
FIG. 5
FIG. 6
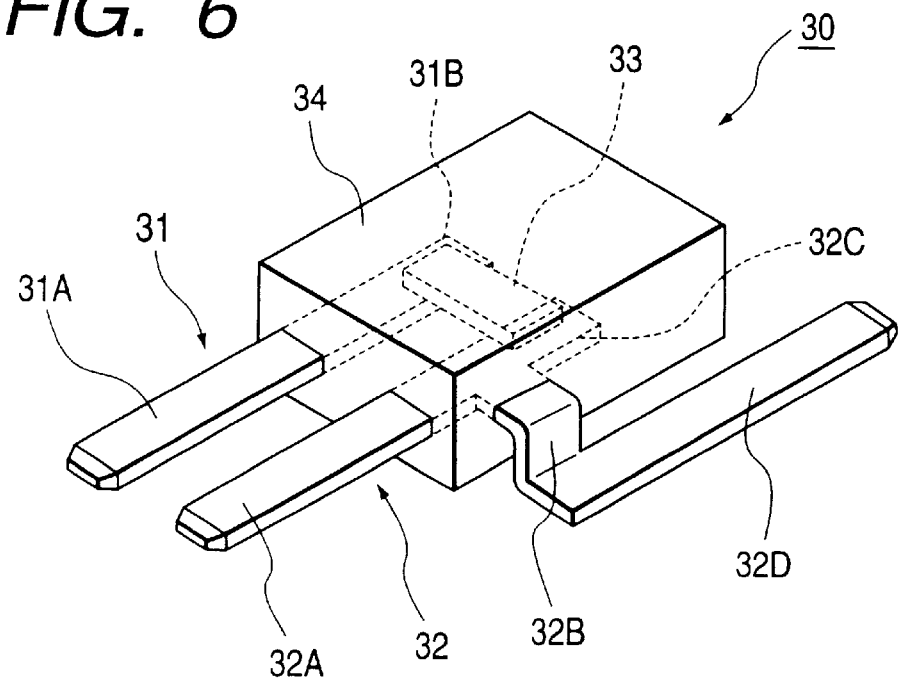

MOLD-TYPE ELECTRONIC PART-CONTAINING CONNECTOR

BACKGROUND OF THE INVENTION

1. Field of Invention

This invention relates to a connector containing a mold-type electronic part, such as a chip resistor.

2. Description of Related Art

A conventional connector, containing a mold-type electronic part, is shown schematically in FIG. 9, with the mold-type electronic part 3 contained in a connector housing 1. The mold-type electronic part 3 includes an electronic element (e.g. a resistor element) 3B molded in a resin body, and, for example, two lead terminal portions 3A extending outwardly from the resin-molded body. The two lead terminal portions 3A project parallelly to four male metal terminals 4M mounted on the connector housing 1. When the connector housing 1 is fitted relative to a mating connector housing 2, the four male metal terminals 4M are connected respectively to four female metal terminals 4F, and the pair of lead terminal portions 3A are connected respectively to the female metal terminals 5.

In such a connector, in order to branch a circuit connected to the mold-type electronic part 3 from the connector housing 1 for wiring purposes, the following method has been used: A branch wire 6A is connected by a splice connection 8 to a wire 5A of the female metal terminal 5 adapted to receive a lead terminal portion 3A. A branch female metal terminal 6, secured to the branch wire 6A, is mounted on the mating connector housing 2 parallel to the other female metal terminals 4F and 5. A branch male metal terminal 7, corresponding to the branch female metal terminal 6, is mounted on the connector housing 1. A branch wire 7A, secured to the branch male metal terminal 7, extends toward the rear side of the connector housing 1. Splicing the wires 5A and 6A, in order to branch wiring from the circuit connected to the mold-type electronic part 3, is a cumbersome operation, therefore diminishes the efficiency wire harness assembly. Also, when the branch wire is extended from the rear side of the connector housing 1, which is close to the mold-type electronic part 3, for wiring purposes, the number of poles at those surfaces of the connector housings 1 and 2 to be fitted together increases because of the addition of the branch metal terminals 6 and 7, increasing the size of the connector.

SUMMARY OF THE INVENTION

The present invention, in view of the above, has as an object to provide construction in which harness-assembling efficiency is enhanced when a branch wire is extended from a circuit connected to a mold-type electronic part.

Another object of the invention is to provide a construction in which the number of poles of a housing does not increase when a branch wire is extended from a circuit connected to a mold-type electronic part therein for wiring purposes.

According to the invention, there is provided a mold-type electronic part-containing connector wherein a mold-type electronic part includes an electronic element molded in a resin body and a plurality of lead terminal portions extending outwardly from the resin-molded body, the mold-type electronic part being contained in a connector housing with the lead terminal portions connectable to mating connectors such that at least one pair among the lead terminal portions of the mold-type electronic part define a branch terminal having a pair of lead terminal portions integrally connected together in the resin-molded body. A metal terminal, previously connected to the branch wire, is refitted on the branch terminal contained in the connector housing, or the branch wire is secured directly to the branch terminal before the branch terminal is mounted in the connector housing. In the present invention, there is no need for the cumbersome operation in which the wires are connected together by a splice connection at a wire harness-assembling site, therefore wire harness assembling efficiency is enhanced.

Another embodiment of the invention provides a pair of lead terminal portions of the branch terminal extending in different directions, respectively. The pair of lead terminal portions of the branch terminal extend in different directions, respectively, therefore the connection of the branch wire to the branch lead terminal portion is effected at that side of the connector housing other than that side fitted on the female connector housing. Therefore, when extending the branch wire from the connector housing containing the mold-type electronic part, the branch lead terminal portion is not disposed at that side of the connector housing fitted to the mating connector. Accordingly, and the number of poles at the fitted side is not increased, therefore a small-sized connector may be achieved.

BRIEF DESCRIPTION OF THE DRAWINGS

Similar reference characters denote corresponding features of the invention consistently throughout the following attached drawings:

FIG. 5 is a partial top right front exploded perspective view of terminal elements constructed according to principles of the invention;

FIG. 6 is a partial top right front perspective view of a mold-type electronic part constructed according to the principles of the invention;

DETAILED DESCRIPTION OF PREFERRED EMBODIMENTS

A first embodiment of the present invention will be described with reference to FIGS. 1 to 7.

Figure 7:
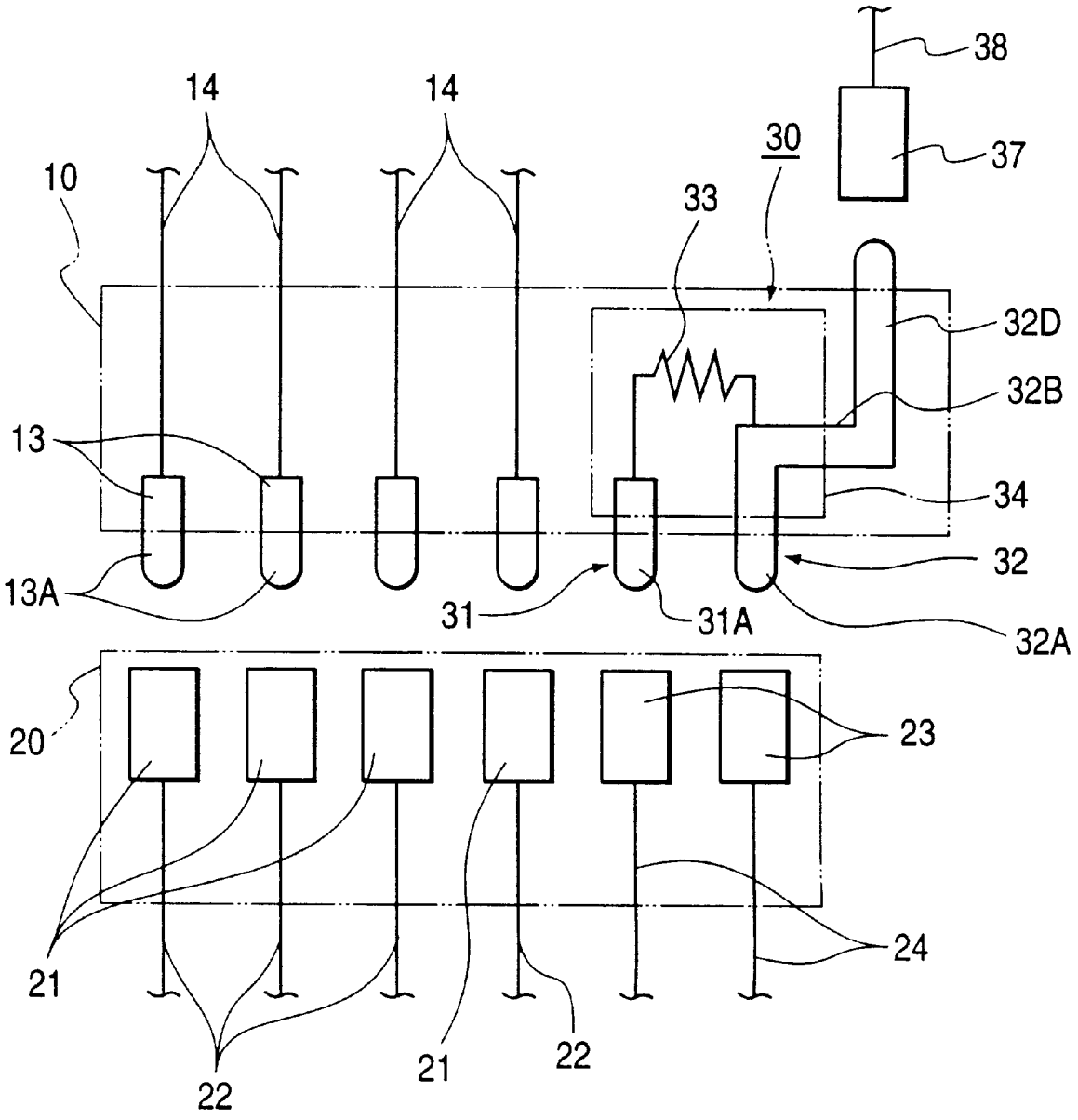
FIG. 7 is a schematic view of wiring configured according to principles of the invention.

A connector of this embodiment includes a male connector housing 10 receivable in a female connector housing 20, shown in FIG. 7, a mold-type electronic part 30, such as a chip resistor and a chip diode, and a retainer 40.

Figure 1:
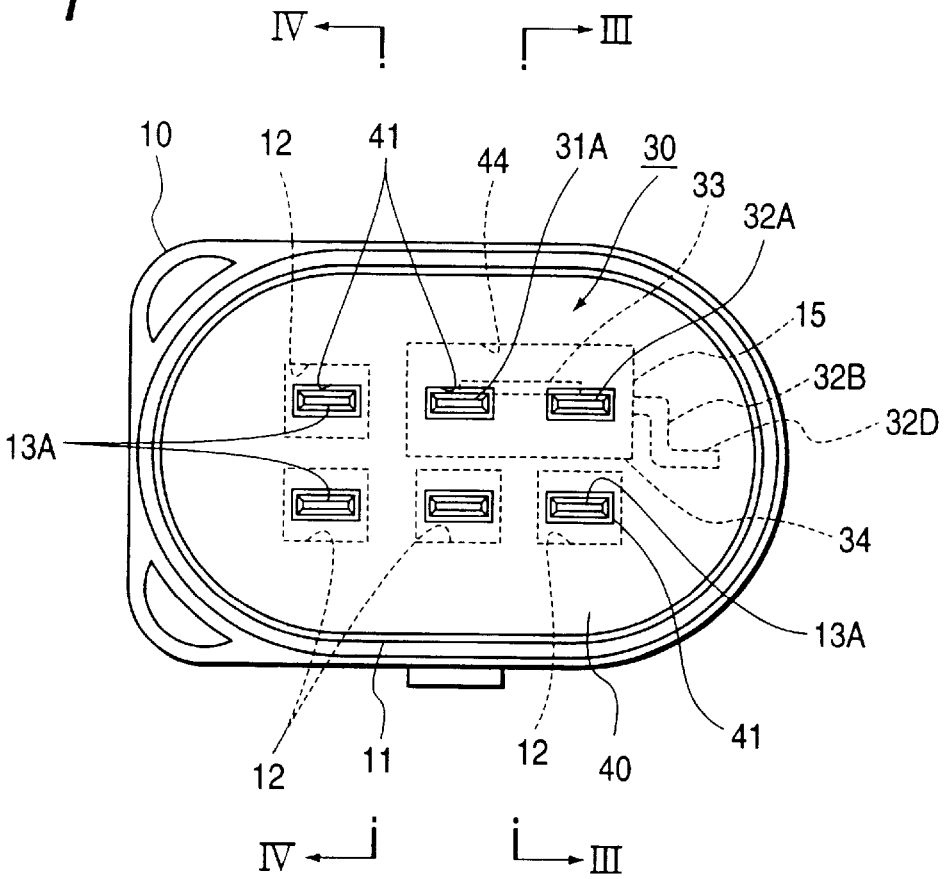
FIG. 1 is a front-elevational view of a connector constructed according to the principles of the invention.

The male connector housing 10 includes a hood portion 11 for fitting on the female connector housing 20, and four cavities 12 open to the hood portion 11. As shown in FIG. 1, one of the four cavities 12 is disposed at a left upper portion of the male connector housing 10 while the other three cavities 12 are juxtaposed at a lower portion of this housing 10. Male metal terminals 13 are received respectively in the cavities 12, the tabs 13A of each projecting into the interior of the hood portion 11. Wires 14, shown in FIG. 4 connected to the male metal terminals 13, extend outwardly from a rear side of the male connector housing 10.

Figure 2:
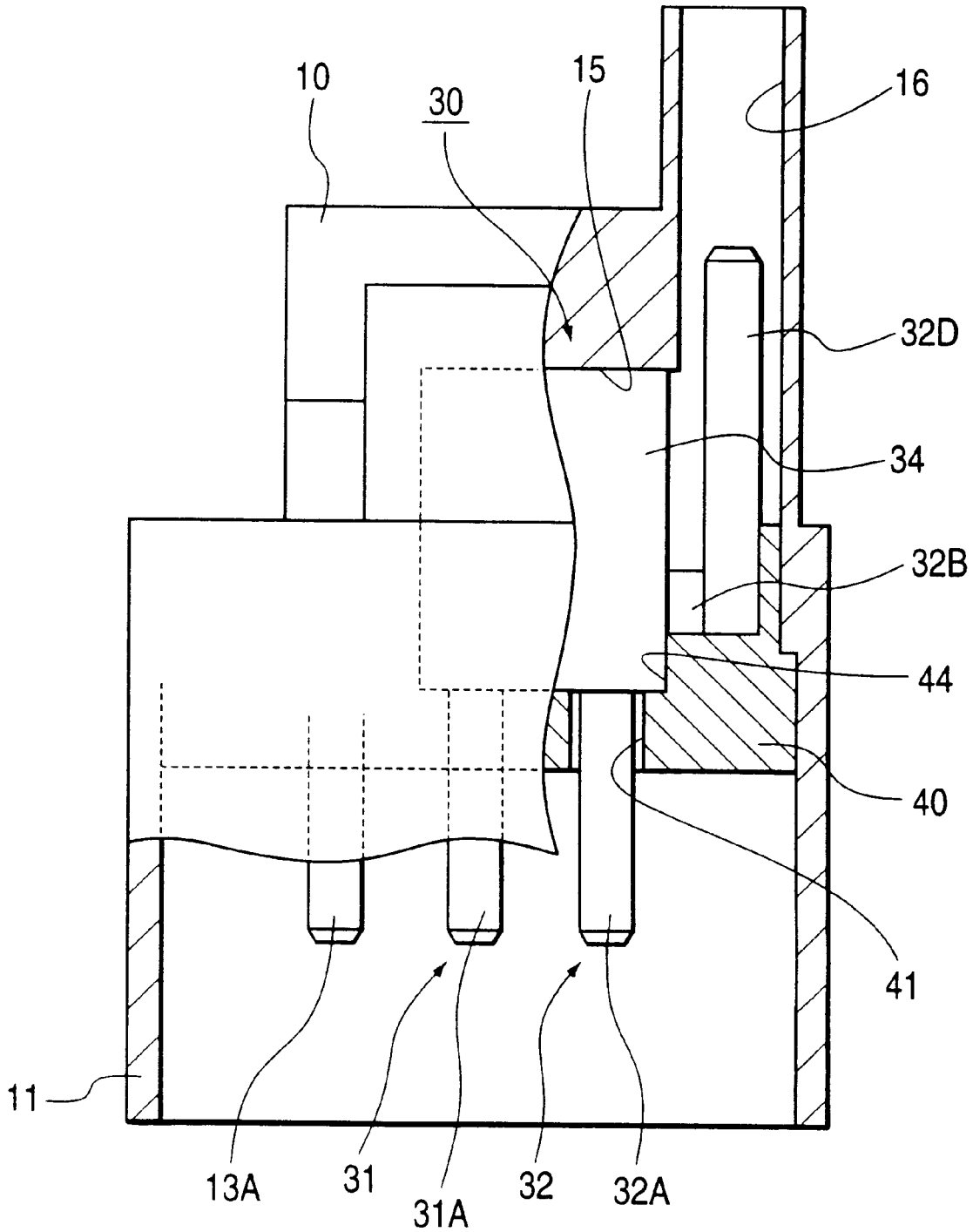
FIG. 2 is a plan view, partially broken, of the embodiment of FIG. 1.

An electronic part-receiving portion 15, shown in FIG. 2, for receiving the mold-type electronic part 30 is formed in the male connector housing 10, and is open to the hood portion 11. As shown in FIG. 1, the electronic part-receiving portion 15 is disposed at a position including a central region and a right side region of the upper portion of the housing 10 which generally are at the same height or level as that of the upper cavity 12.

Referring to FIG. 2, a narrow, tubular branch fitting portion 16 is formed on and extends rearwardly from the rear side of the male connector housing 10. This branch fitting portion 16 is in communication with the electronic part-receiving portion 15 and the hood portion 11. When the mold-type electronic part 30 is inserted into the electronic part-receiving portion 15 through an opening in the hood portion 11, a branch lead terminal portion 32D described below, is inserted into the branch fitting portion 16. In this branch fitting portion 16, a branch female metal terminal 37, shown in FIG. 7, secured to a branch wire 38, is adapted to be connected to the lead terminal portion 32D.

The retainer 40 retains the male metal terminals 13 and the mold-type electronic part 30. The retainer 40 is fitted into an inner end portion of the hood portion 11. In the fitted condition of the retainer 40, referring to FIG. 4, the male metal terminals 13 and lead terminal portions 31A and 32A of the mold-type electronic part 30, shown in FIG. 1, are passed respectively through through holes 41 formed in the retainer 40. Also, in the fitted condition of the retainer 40, projected portions 42 and 43, formed on a rear side of the retainer 40, are held in contact respectively with lower surfaces of lances 12A of the cavities 12, thereby preventing the lances 12A from being flexed in a direction to allow the withdrawal of the male metal terminals 13, thereby retaining the male metal terminals 13 in a redundant manner. A projection 43A, formed at a distal end of the lower projected portion 43, is engaged with a distal end of the lance 12A, thereby retaining the retainer 40 relative to the male connector housing 10.

Figure 3:
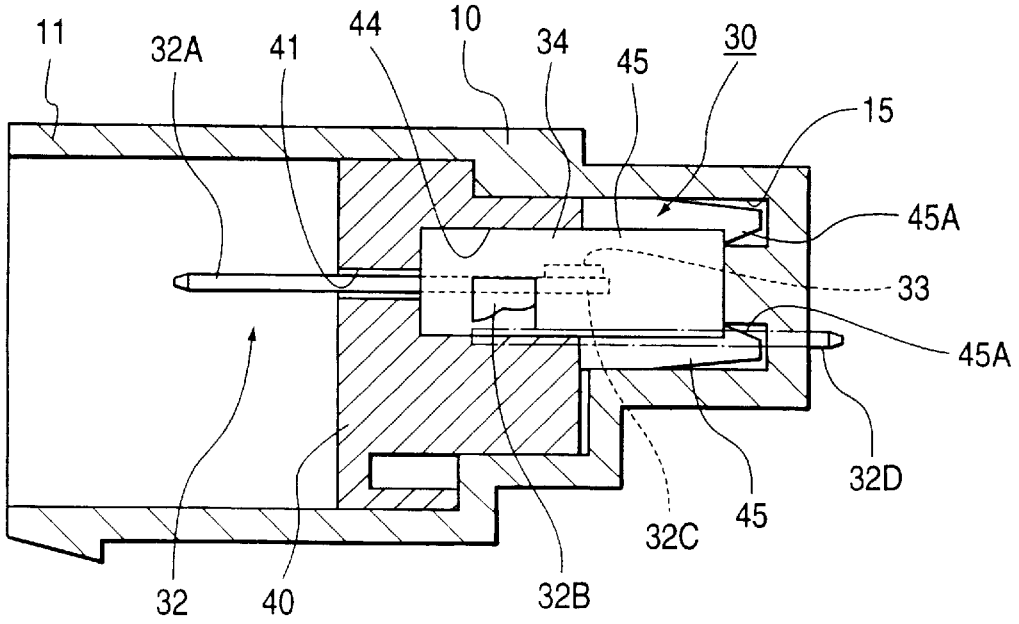
FIG. 3 is a cross-sectional detail view, drawn along line III—III, of the embodiment of FIG. 1.

Referring to FIG. 3, an electronic part-fitting portion 44 is formed in the rear surface of the retainer 40, and a pair of upper and lower elastic retaining piece portions 45 project rearwardly from an edge portion of an open end of the electric part-fitting portion 44. A generally front half of a package 34 of the mold-type electronic part 30 is fitted in the electronic part-fitting portion 44, and claws 45A of the elastic retaining piece portions 45 are retainingly engaged with a rear end of the package 34.

Referring to FIG. 6, the mold-type electronic part 30 includes a lead metal terminal 31, a branch metal terminal 32 and an electronic element, such as a resistor or diode. The lead metal terminal 31 has a lead terminal portion 31A with the shape of a narrow, elongated plate disposed parallel with the tabs 13A, as shown in FIG. 1. A contact portion 31B is formed at a proximal end of the lead terminal portion 31A. The electronic element 33 is placed on this contact portion 31B.

The branch metal terminal 32 has the lead terminal portion 32A disposed parallel with the lead metal terminal 31 with a plate-like connecting portion 32B extending laterally from that portion of the lead terminal portion 32A disposed near to a rear end thereof and a narrow, elongated plate-like lead terminal portion 32D extending from the connecting portion 32B rearwardly, in a direction opposite to the projecting direction of the lead terminal portion 32A, in downwardly-stepped relationship to the lead terminal portion 32A. A rear end portion of the lead terminal portion 32A serves as a contact portion 32C juxtaposed to the contact portion 31B of the lead metal terminal 31.

In the manufacture of the mold-type electronic part 30, the lead terminal portions 31A and 32A of the lead metal terminal 31 and the branch metal terminal 32 are maintained parallel with each other. Then, cream-like solder is coated onto the contact portions 31B and 32C, and the electronic element 33 is placed on the two contact portions 31B and 32C in a bridge-like manner. The assembly is introduced into a furnace (not shown), and the solder is melted to secure the electronic element 33 to the two contact portions 31B and 32C. This assembly then is molded in a resin within a case (not shown), thereby forming the package or body 34 of integral construction. The lead terminals 31A and 32A extend outwardly from a front surface of the package 34, the lead terminal portion 32D, electrically connected to the lead terminal portion 32A within the package 34, extends outwardly from a side surface of the package 34.

Figure 4:
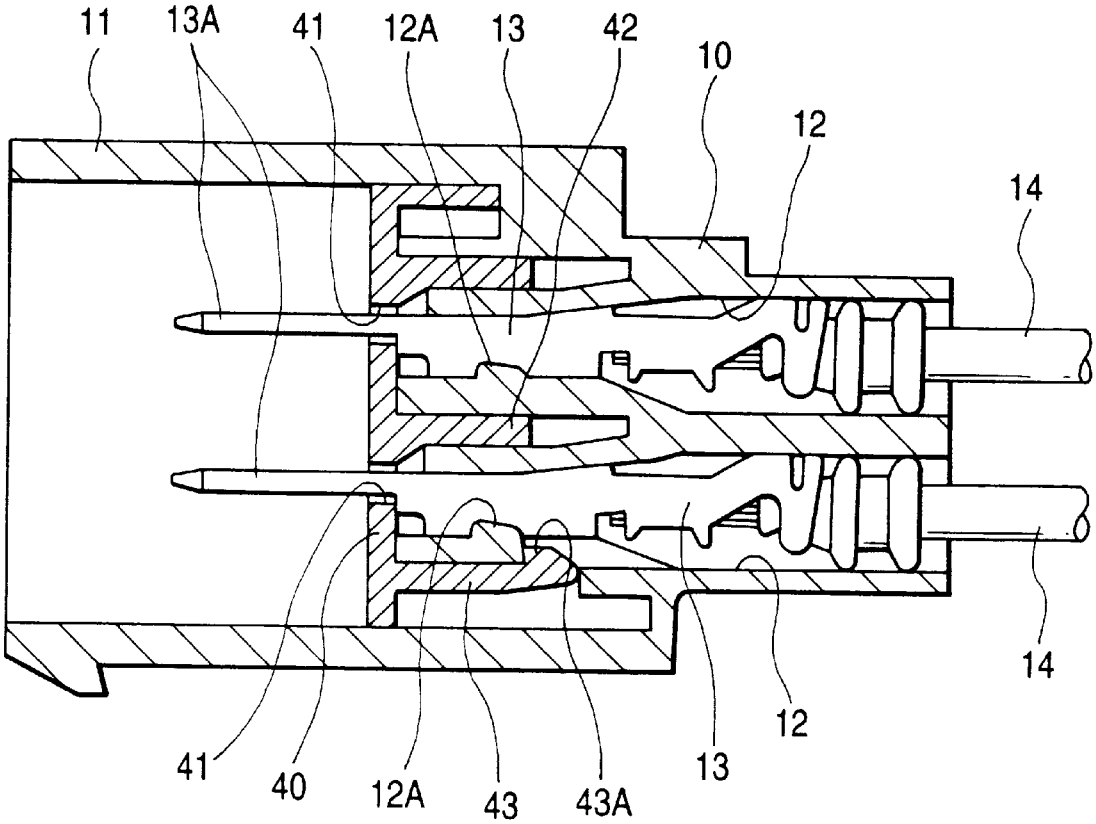
FIG. 4 is a cross-sectional detail view, drawn along line IV—IV, of the embodiment of FIG. 1.

Referring to FIG. 3, this mold-type electronic part 30 is fitted into the electronic part-fitting portion 44 in the retainer 40, and the elastic retaining piece portions 45 are retainingly engaged with the rear end of the package 34, thereby retaining the mold-type electronic part 30 on the retainer 40. In this condition, the lead terminal portions 31A and 32A pass respectively through the through holes 41, and project forwardly. When the retainer 40, holding the mold-type electronic part 30, is fitted into the hood portion 11, the rear end portion of the package 34 and the elastic retaining piece portions 45 are received in the electronic part-receiving portion 15. Also, the lead terminal portion 32D is received in the branch fitting portion 16, as shown in FIG. 2. In this condition, the projection 43A on the projected portion 43 of the retainer 40 is retainingly engaged with the lower lance 12A, thereby preventing the withdrawal of the retainer 40 as shown in FIG. 4, thus the mold-type electronic part 30 is mounted and contained in the male connector housing 10. In this mounted condition, as shown in FIG. 2, the lead terminal portions 31A and 32A are disposed at the same height as, and parallel with, the male metal terminal 13A disposed at the upper portion of the male connector housing 10 as well as the lower row of male terminals 13A.

Referring to FIG. 7, the female connector housing 20 is adapted to be fitted into the hood portion 11. The female connector housing 20 has female meal terminals 21 and 23 provided therein. Although not shown, the female metal terminals 21 and 23 are arranged in two rows corresponding to the male metal terminals 13 and the lead terminal portions 31A and 32A. Wires 22, secured to the female metal terminals 21, and wires 24, secured to the female metal terminals 23, extend outwardly from a rear side of the female connector housing 20.

When the male and female connector housings 10 and 20 are fitted together, the four male metal terminals 13 are connected to the associated female metal terminals 21 and the other two female metal terminals 23 are connected to the lead terminal portions 31A and 32A, respectively, so that these two female metal terminals 23 are electrically connected together through the electronic element 33. At the rear side of the male connector housing 10, the branch female metal terminal 37 is connected to the branch lead terminal portion 32D of the branch metal terminal 32 extending in the direction opposite to the direction of the extension of the lead terminal portion 31A. As a result, the branch wire 38, connected to the branch female metal terminal 37, is electrically connected to the female-side wire 24 connected to the electronic element 33.

The branch lead terminal portion 32D is connected integrally to the lead terminal portion 32A, adapted to be connected to the female connector housing 20, in the package 34, therefore, when providing a branch wiring from the female-side wire 24, connected to the mold-type electronic part 30, at a wire harness-assembling site, this may be effected easily merely by fitting the branch female metal terminal 37, beforehand secured to the branch wire 38, on the lead terminal portion 32D. As compared with conventional construction, there is no need for the cumbersome operation in which the female-side wire and the branch wire are connected together by a splice connection, therefore wire harness assembling efficiency is enhanced.

The branch wire 38 is adapted to extend from the male connector housing 10 containing the mold-type electronic part 30, therefore the lead terminal portion 32D projects from the rear side of the male connector housing 10. Accordingly, the connection of the branch wire 38 to the lead terminal portion 32D is effected at the side of the male connector housing 10 other than the side mounted on the female connector housing 20. As compared with when the branch terminals are provided on the mating surfaces, the number of poles at these surfaces is reduced, therefore connector size reduction may be achieved.

Figure 8:
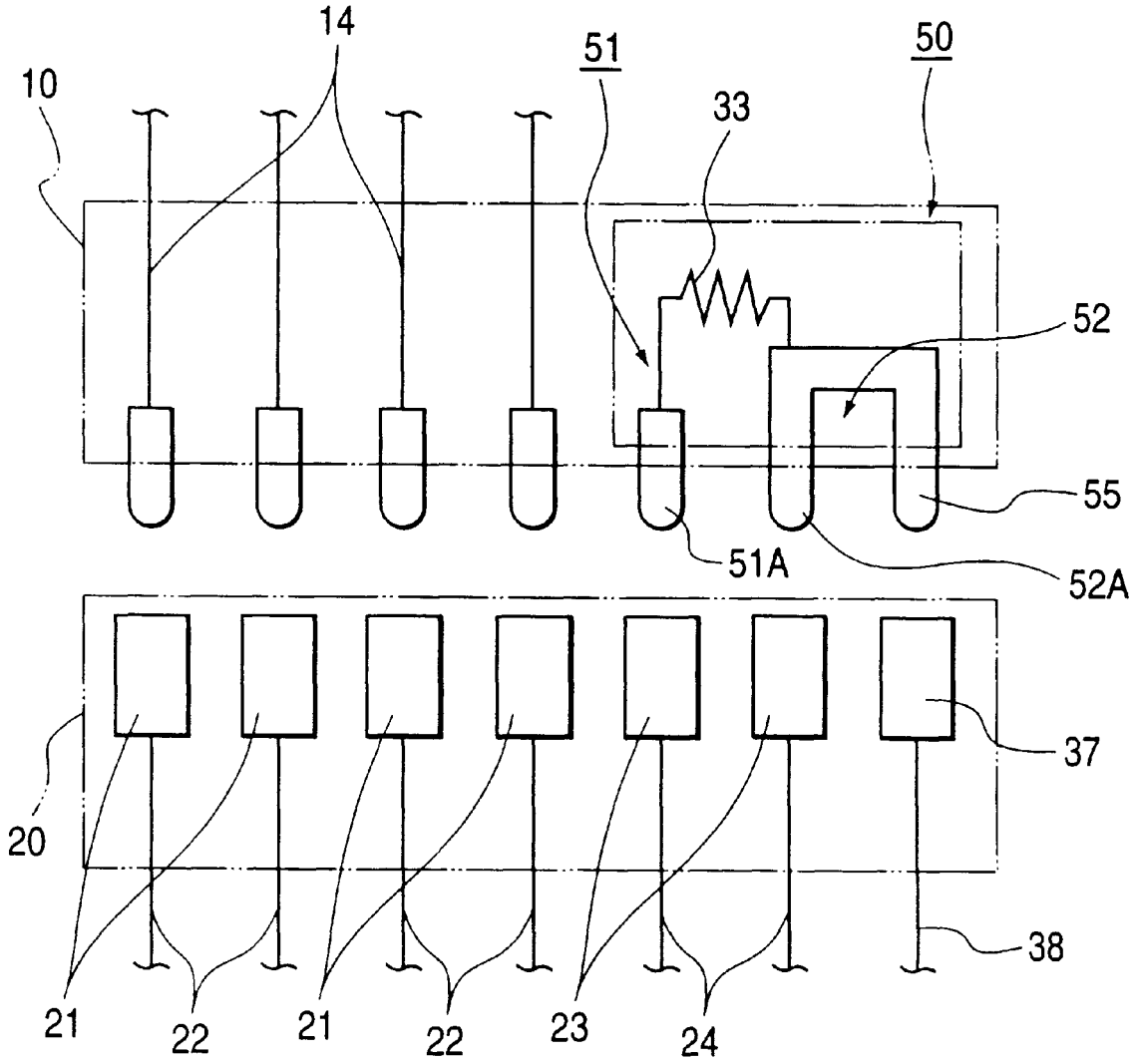
FIG. 8 is another schematic view of wiring configured according to principles of the invention.
Figure 9:
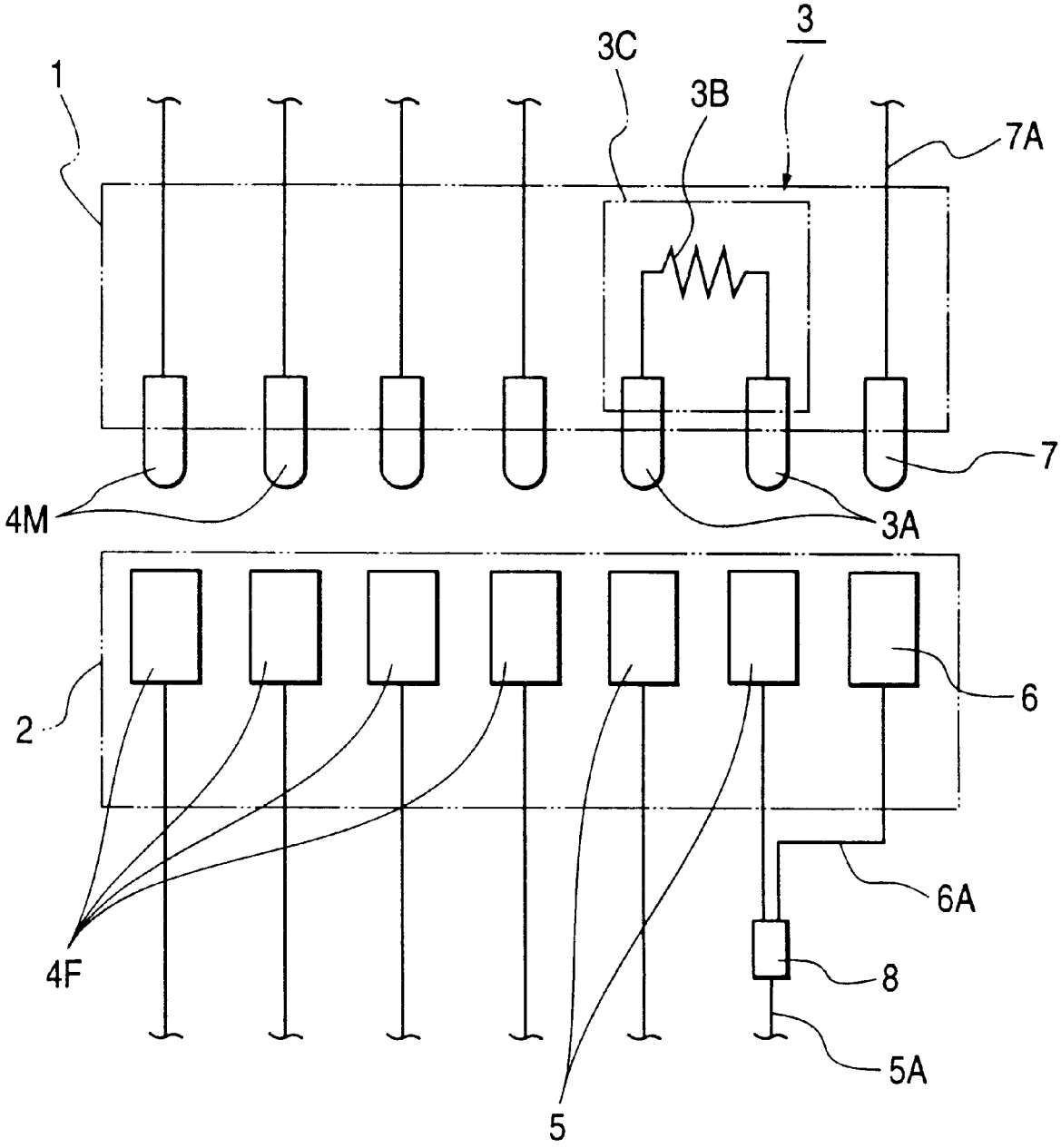
FIG. 9 (PRIOR ART)
FIG. 9 is a schematic view of a conventional wiring configuration.

Another embodiment of the present invention will be described with reference to FIG. 8. In this embodiment, only the arrangement of the branch wire is different from that of the above embodiment. Construction of the rest of the device is similar to that of the above embodiment, therefore similar portions will be designated by similar reference numerals, respectively, and explanation of construction, operation and effects thereof will be omitted.

In the above embodiment, the branch wire 38 is extended from the male connector housing 10. In this embodiment, a branch wire 38 is extended from the female connector housing 20. In the mold-type electronic part 50 in this embodiment, a branch lead terminal portion 55 of a branch metal terminal 52, like a lead terminal portion 52A of the branch metal terminal 52 and a lead terminal portion 51A of a lead metal terminal 51, extends toward that side of the male connector housing 10 in registry with the corresponding female connector housing 20. In this connection, a branch female metal terminal 37, corresponding to the lead terminal portion 55, is provided at a fitting side of the female connector housing 20. When the two connector housings 10 and 20 are fitted together, the branch female metal terminal 37 is connected to the lead terminal portion 55, and the branch wire 38, connected to this branch female metal terminal 37, extends from a rear side of the female connector housing 20. Also, when providing a branch wiring from the female-side wire 24, connected to the mold-type electronic part 50, at a wire harness-assembling site, this can be easily effected by fitting the branch female metal terminal 37 on the lead terminal portion 55. Accordingly, there is no need for the cumbersome operation in which the wires are connected together by the splice connection, and operation efficiency is enhanced.

Particularly in the above embodiment, the connection of the lead terminal portion 55 to the branch female metal terminal 37 is effected at the same time when the two connector housings 10 and 20 are fitted together, therefore a separate connection operation for branch wiring is not necessary, thus enhancing assembly efficiency.

Although the mold-type electronic part is shown and described above as having three lead terminals, the invention may be applied to a mold-type electronic part having four or more lead terminals. Similarly, although the connector has 6 poles, the invention may be applied to a connector having 5 or less poles, or 7 or more poles. Likewise, in the other embodiment, although the connector has 7 poles, the invention may be applied to a connector having 6 or less poles, or 8 or more poles.

Although only one branch lead terminal portion is shown and described as being extended, a plurality of branch lead terminal portions may be extended in the present invention.

Although the branch lead terminal portion is shown and described as extending toward the rear side of the male connector housing, the branch lead terminal portion may extend toward the periphery, the upper side or the lower side of the male connector housing 10.

Although the branch female metal terminal, previously secured to the branch wire, is adapted to be fitted on the branch lead terminal portion, the invention may provide for an arrangement in which a wire connection portion is formed at a branch lead terminal portion and, before the mold-type electronic part is contained in the connector housing, the branch wire is secured directly to this wire connection portion.

Although the mold-type electronic part is retained by the retainer, the retainer then being mounted in the connector housing, the mold-type electronic part may be retained directly in the connector housing.

Although the mold-type electronic part is mounted in the male connector housing, the mold-type electronic part may be mounted in the female connector housing.

The present invention is not limited to the above embodiments but encompasses all modifications and improvements falling within the scope of the appended claims.

What is claimed is:

1. An electronic connector comprising:

a first contact;

a second contact;

a third contact electrically and integrally connected to said first contact so as to form a single continuous element;

an electronic element electrically connecting said first contact and said second contact; and a body disposed such that at least a portion of each of said first contact, said second contact, and said third contact extends therefrom;

said body being received in a housing which provides access to one of said first contact, said second contact and said third contact.

2. The electronic connector of claim 1, wherein said electronic element is selected from the group consisting of a resistor, a diode and combinations thereof.

3. The electronic connector of claim 1, wherein said first contact, said second contact and said third contact are selected from the group consisting of male connectors, female connectors and combinations thereof.

4. The electronic connector of claim 1, wherein said body is constructed from curable resin.

5. The electronic connector of claim 1, wherein said first contact extends in a first direction and said third contact extends in a second direction.

6. The electronic connector of claim 5, wherein said first direction is opposite to said second direction.

7. The electronic connector of claim 1, further comprising a retainer mounted in the housing.

8. The electronic connector of claim 7, wherein said retainer is adapted to retain said body in the housing.

9. The electronic connector of claim 7, wherein said retainer is adapted to fix said retainer on the housing.

10. The electronic connector of claim 7, wherein said retainer is adapted to retain terminals received therein.

11. The electronic connector of claim 7, wherein said retainer is adapted to retain said body thereto.

* * * * *

UNITED STATES PATENT AND TRADEMARK OFFICE

CERTIFICATE OF CORRRECTION

PATENT NO. : 6,010,366
DATED : January 4, 2000
INVENTOR(S) : Fumiyoshi Tanigawa, et al.

It is certified that error appears in the above-identified patent and that said Letters Patent is hereby corrected as shown below:

On the title page, item [56]

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 4 | 2 | 3 | 9 | 3 | 1 | 9 | 12/1980 | Gladd et al | 439 | | |
| | | 4 | 3 | 8 | 6 | 8 | 1 | 8 | 06/1983 | Milhimes et al | 439 | | |
| | | 4 | 6 | 5 | 4 | 7 | 4 | 3 | 03/1987 | Ruehl et al | 439 | | |

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | EP | 0 | 3 | 1 | 7 | 1 | 16 | A 1 | 05/1989 | Europe | | | | |

Signed and Sealed this

Sixteenth Day of May, 2000

*Attest:*

Q. TODD DICKINSON

*Attesting Officer*

*Director of Patents and Trademarks*